United States Patent [19]

Volakakis et al.

[11] Patent Number: 4,511,048

[45] Date of Patent: Apr. 16, 1985

[54] JIB CRANE SYSTEM HAVING A ROTATABLE MAST

[75] Inventors: John G. Volakakis, La Grange; Robert L. McNelis, Glen Ellyn; Burt H. Wallentin, La Grange, all of Ill.

[73] Assignee: Handling Systems, Inc., La Grange, Ill.

[21] Appl. No.: 384,883

[22] Filed: Jun. 4, 1982

[51] Int. Cl.[3] ..... B66C 23/84

[52] U.S. Cl. ..... 212/253; 212/223; 212/225

[58] Field of Search ..... 212/205, 210, 223, 225, 212/245, 253, 271

[56] References Cited

U.S. PATENT DOCUMENTS

| | | | |
|---|---|---|---|
| 1,018,723 | 2/1912 | Milley | 212/225 |
| 1,111,416 | 9/1914 | Taylor | 212/253 |
| 1,551,768 | 9/1925 | Otis | 212/253 |
| 3,106,298 | 10/1963 | Kerridge | 212/253 |
| 3,358,849 | 12/1967 | Becker | 212/225 |
| 4,061,230 | 12/1977 | Goss et al. | 212/253 |

FOREIGN PATENT DOCUMENTS

| | | | |
|---|---|---|---|
| 243841 | 3/1963 | Australia | 212/253 |
| 2247177 | 4/1974 | Fed. Rep. of Germany | 212/267 |
| 2421836 | 2/1979 | France | 212/253 |
| 392006 | 9/1965 | Switzerland | 212/223 |
| 884 | of 1865 | United Kingdom | 212/223 |
| 1090839 | 11/1967 | United Kingdom | 212/253 |
| 429013 | 11/1974 | U.S.S.R. | 212/253 |

*Primary Examiner*—Trygve M. Blix
*Assistant Examiner*—R. B. Johnson
*Attorney, Agent, or Firm*—Jerome Goldberg

[57] ABSTRACT

A jib crane system comprising a horizontally extending load beam rigidly attached to the upper end of a vertically extending mast. The lower of the mast extends inside a hollow pipe and is rotatably associated with a base plate assembly or rotatably secured in the foundation at the site of the crane. Roller bearings are rigidly secured to the mast and positioned in frictional contact with the pipe. The roller bearing revolves around the circumference of the pipe as the mast and load beam rotate around the central axis of the mast. The roller bearings are adjustable for varying the frictional contact of the rollers with the pipe.

4 Claims, 23 Drawing Figures

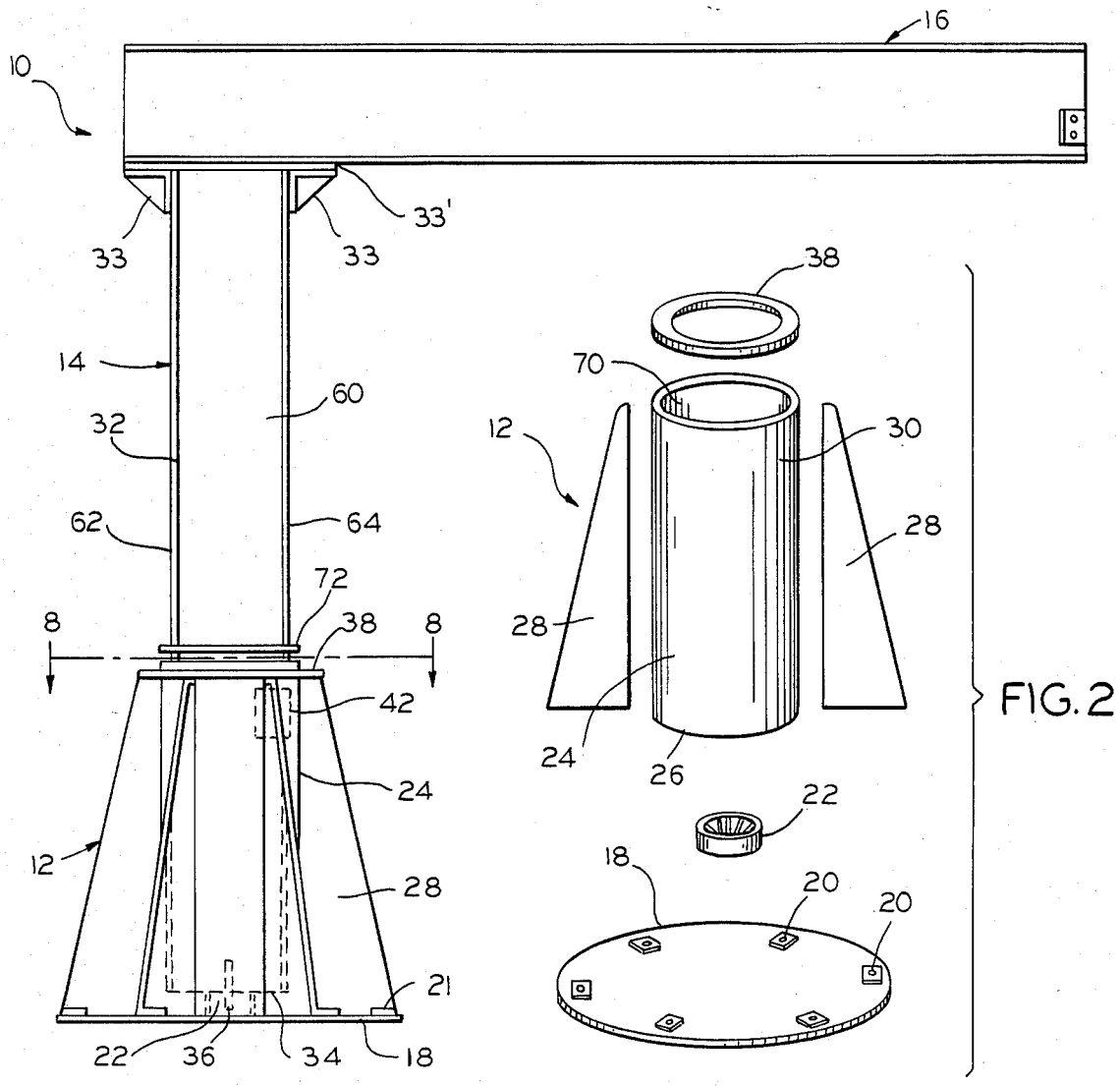
FIG. 1
FIG. 2
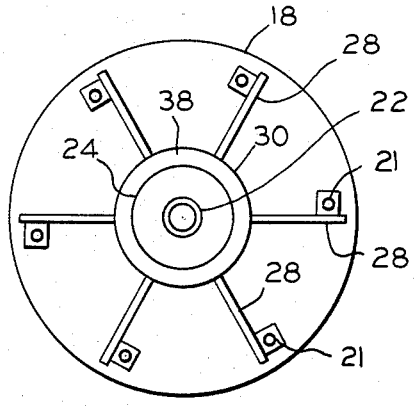
FIG. 3
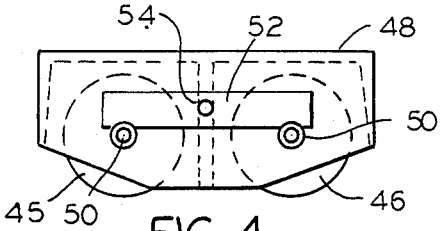
FIG. 4
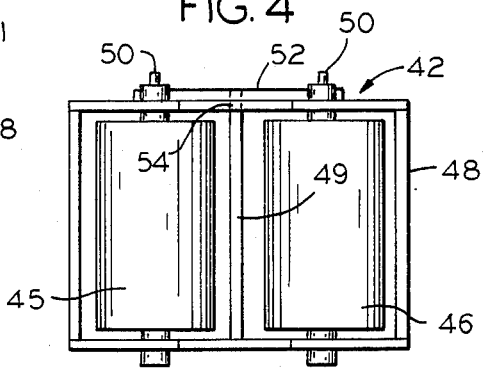
FIG. 5
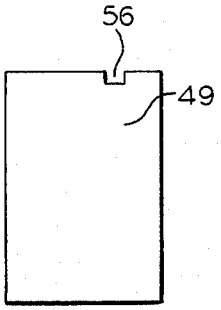
FIG. 6

JIB CRANE SYSTEM HAVING A ROTATABLE MAST

BACKGROUND OF THE INVENTION

This invention relates generally to cranes and more specifically relates to cranes which rotate around a central axis, such as a jib crane.

The jib cranes used prior to the invention herein generally comprised a base plate for mounting the crane on the floor or foundation. A mast or pillar usually of a circular cross section, was welded or otherwise secured at the lower end to the base plate. Alternatively, the mast may be rigidly fastened in a concrete or structural steel foundation. A mast head bearing assembly was rotatably secured to the upper end of the mast. A boom or load beam was attached to the bearing assembly. The boom, unless otherwise desired, may be rotated in either direction for 360 degrees. The rotation of the boom and bearing assembly may be powered by air motor means, electrical motor means or hydraulic means, and in many instances may be manually controlled. The mast head bearing assembly included roller bearing means positioned at a fixed vertical height on the mast and revolved around the circumference of the mast, responsive to the rotation of the boom. Therefore, the prior jib crane consisted of three primary sections: the mast or pillar rigidly attached to the base plate (or secured in the foundation); the boom or load beam; and the rotatable mast head assembly. The three sections of the jib crane were generally operatively assembled in the field.

In order to achieve efficient operation of the crane it is required that the mast should be plumb and the boom level with respect to the ground and substantially perpendicular to the mast. When assembling the crane sections at the plant site, the boom was set at the proper level and the roller bearing means which revolves around the mast head was adjusted for proper frictional contact. In the event the mast became disaligned or initially was not plumb, shims or grouting was inserted at the base of the crane for obtaining the desired plumbness. If the mast is not plumb, the load or hoist could run away along the boom or the boom could rotate freely on its own. Usually, when the mast is plumb, the boom is also level with respect to ground. However, at times the boom of the prior jib cranes required level adjustment independent of the mast plumbness, or the bearing rollers needed adjustment due to wear or to vary the thrust forces acting on the mast from the loads carried by the boom. However, subsequent to the initial installation, the boom level and roller contact were very infrequently checked, if at all, due to the extreme inconvenience to make any corrective adjustments on the top of the mast. The subject invention overcomes this problem by rigidly securing the boom to the upper end of the mast, and any removable attachments or adjustments are conveniently placed within easy access from the floor area.

Previously, jib cranes having a rotating mast were also used. These jib cranes included a vertically extending mast having a lower end rotatably secured to a base plate and an upper end rigidly secured to a boom or load beam. The mast extended into a hollow pipe which was spaced from the inside surface thereof. Rollers were secured to the boom and in frictional contact with the pipe and revolved around the outside of the pipe as the mast and boom rotated. In the jib cranes described below in the Specification, the rollers are secured to the mast and in frictional contact with the pipe. In this manner, the rollers provide greater support for maintaining the plumbness of the mast. If the mast is not plumb, the position of the rollers could be adjusted for realigning the mast. Moreover, the subject invention, discloses means for precisely adjusting the position of the rollers and thereby controlling the transfer of the load forces from the boom to the mast substantially independent of the structural configuration of the mast.

In recent years, the crane business has become extremely competitive, as labor, materials and freight costs have sharply increased, and at the same time the availability of funds for captial expenditures have either decreased or high interest rates have discouraged excessive debt financing. In view of this situation, the subject invention is directed to the reduction of cost of materials without effecting performance and provides a jib crane which may utilize an "I" beam, wide flange beam, fabricated plate, channelled beam, or a tubing structure for the mast. Therefore, depending upon the design load specifications, a less expensive type structure could replace the more conventionally used tubing or cylindrical structure for the mast.

SUMMARY OF THE INVENTION

A jib crane system of this invention includes a base assembly, an upright mast and a horizontally extending boom or load beam on which a hoist may be moved therealong or rotated from one location to another. The load beam is rigidly secured to the upper end of the mast. The bottom portion of the mast is positioned inside a hollow pipe and spaced from the inside wall thereof. The pipe is rigidly mounted on a base plate (or the pipe may be mounted in the foundation). The lower end of the mast is received in a bearing means also mounted on the base plate, to enable the mast and load beam to revolve around its own axis. Thrust roller bearing means is rigidly secured to the mast and the rollers of the roller bearing means frictionally contact the pipe, and revolve around the circumference of the pipe as the mast and load beam rotate around the central axis of the mast. In the described embodiments, the roller bearing means either revolve around the inside circumference of the pipe or revolve around the outside circumference of the pipe. The frictional contact of the rollers with the pipe may be adjusted to control the forces acting on the mast. The cooperation of the mast, the roller bearing means and the pipe enables various structural configurations to be utilized for the mast, such as "I" beam, wide flange beam, fabricated plate, rectangular channels or cylindrical tubing. Adjustments means are provided for precisely controlling the forces from the load beam acting on the mast.

It is therefore a primary object of this invention to provide a jib crane system having a rotatable mast and a load beam rigidly attached to the upper end of the mast.

Another object is to provide means so that the mast may be constructed from "I" beam, wide flange beam, rectangular channels, pipe or other suitable configuration.

A primary feature of the invention is to provide a hollow structural member to enclose the lower end of the mast and roller bearing means rigidly attached to the mast and frictionally contacting the structural member, so that the roller bearing means revolves around the circumference of the structural member as the mast rotates.

Still another object is to provide adjustment means at a convenient location to vary the contact of the roller bearing means against the structural memeber.

Still another object is to rigidly attach the load beam to the mast so that adjusting the plumbness of the mast in turn corrects the level of the load beam.

Further objects and features of the invention will be apparent from the following specification and claims when considered in connection with the accompanying drawings illustrating the preferred embodiments of the invention.

BRIEF DESCRIPTION OF THE DRAWINGS

Referring now to the drawings, in which the same characters of reference are employed to indicate corresponding similar parts throughout the several figures of the drawings:

FIG. 1 is a side elevational view of a jib crane embodying the principals of the invention;

FIG. 2 is a perspective exploded view of the base assembly of FIG. 3;

FIG. 3 is a top view of the base assembly of the jib crane in FIG. 1;

FIG. 4 is a top view of the thrust roller bearing means;

FIG. 5 is a side view of the roller means in FIG. 4;

FIG. 6 illustrates the partition reinforcing wall between the thrust rollers of the bearing means;

DESCRIPTION OF THE PREFERRED EMBODIMENTS

Figure 7:
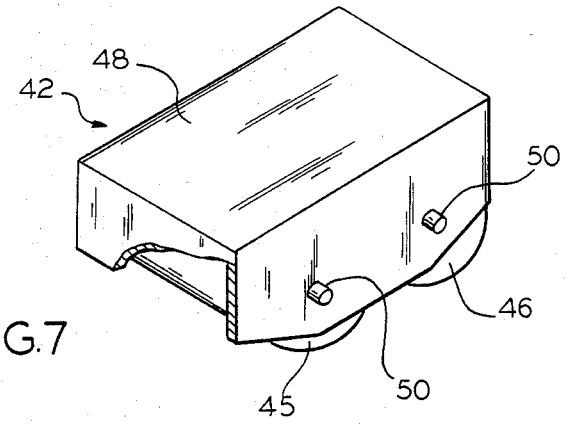
FIG. 7 is a perspective view of the roller bearing means.

Referring now to FIG. 1 of the drawings, the reference numberal 10 indicates generally a jib crane comprising a base assembly 12, a mast assembly 14 and a load beam or boom 16.

Turning now more specifically to FIGS. 1, 2, and 3, it will be seen that the base assembly 12 includes a circular base plate 18 having a plurality of mounting holes 20 spaced slightly inward from the outer periphery. Anchor bolts 21 are received in the holes 20 and fasten the jib crane 10 to the floor or foundation. A tapered thrust bearing cup and housing 22 which may have a bevel or other suitable gearing on the inside thereof, is welded or otherwise rigidly secured to the center of the plate 18. A hollow, circular and open ended pipe 24 having a diameter less than the plate 18 is also welded or otherwise rigidly secured at its lower end 26 to the plate 18. Pipe 24 is positioned over the bearing cup 22.

Spaced apart gusset plates 28 of a substantially right triangular shape are welded to the plate 18 and to the outer wall 30 of the pipe 24. In the illustrative embodiment six gusset plates 28 are used, but this number could be varied depending upon the design load for the specific jib crane.

The mast assembly 14 (FIG. 1) includes a vertical structure or pillar 32, which may be constructed from "I" beam, wide flange beam, fabricated plate, rectangular tubing or pipe. FIG. 1 illustrates the pillar 32 having an "I" beam construction. The loading of the jib crane 10 will determine the various vertical structures which may be suitably used. The width or diameter of the pillar 32, as the case may be, is less than the internal diameter of the pipe 24.

Triangular shaped brackets 33 are welded to the upper end of the mast 14 and to a boss plate plate 33' rigidly secured between the mast 14 and the load beam 16 (FIG. 1). The load beam 16 includes inboard and outboard end stops (not shown) to limit or confine the extent of hoist travel therealong.

The bottom end 34 of the pillar 32 includes a cutout 35, centrally positioned to receive a pin 36 (FIG. 12), preferably constructed from steel. The pin 36 is welded to the defining edges of the cutout 35 and protrudes downward from the bottom end 34 of the pillar 32. A collar 38 is pressfitted over the pipe 24 at the upper end thereof to abut the gussets 28.

Figure 12:
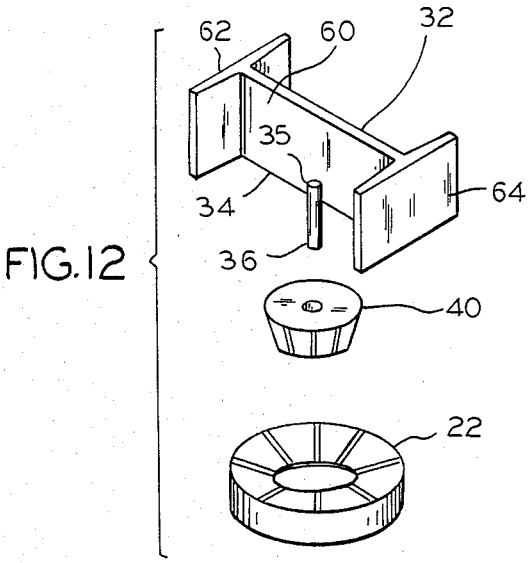
FIG. 12 is a perspective view illustrating the pin and bearing arrangement for revolving the jib crane and showing the pin secured to the bottom end of the "I" beam.
Figure 11:
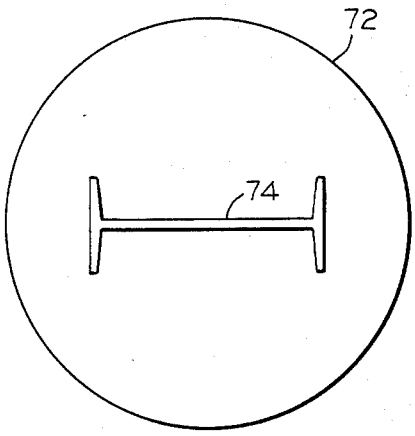
FIG. 11 is a top view of the safety plate which is positioned on the top of the pipe of the base means, and showing a cutout for receiving the "I" beam therethrough.

A tapered bearing 40 or other suitable bearing is secured on the pin 36 (FIG. 12). When the pillar 32 is lowered into the pipe 24, bearing 40 meshes with the complementary gearing of the bearing cup 22.

Figure 8:
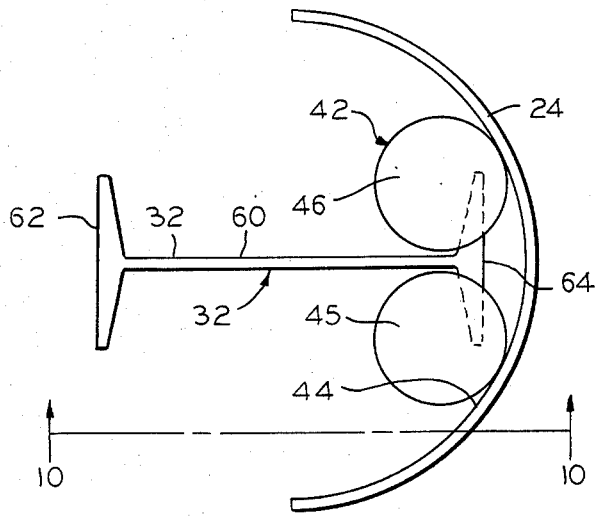
FIG. 8 is a top view (with parts cut away for convenience of illustration), taken on the plane of the line 8—8 in FIG. 1 and viewed in the direction indicated to illustrate the rollers of the thrust roller bearing means in contact with the inside of the pipe of the base assembly.
Figure 10:
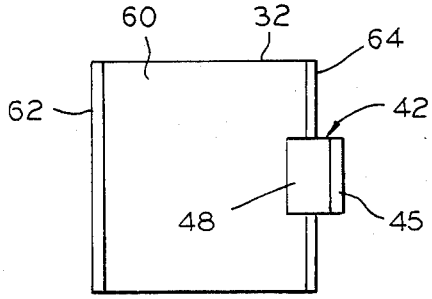
FIG. 10 is a front view of the "I" beam section in FIG. 9 with the roller bearing means in the operative position.

A roller bearing means 42 is attached to the pillar 32 at a predetermined level therealong, for frictionally contacting the inside surface 44 of the pipe 24, as may be seen specifically in FIG. 8.

Figure 13:
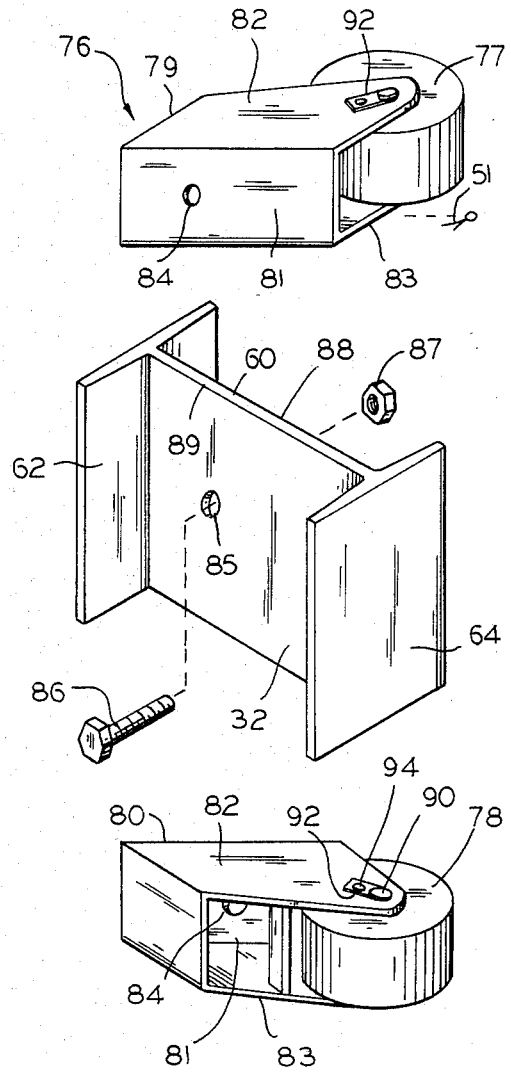
FIG. 13 is a perspective view of another embodiment for the roller bearing means and showing the rollers spaced from the "I" beam (shown as a segment of the "I" beam) prior to being bolted thereto.
Figure 14:
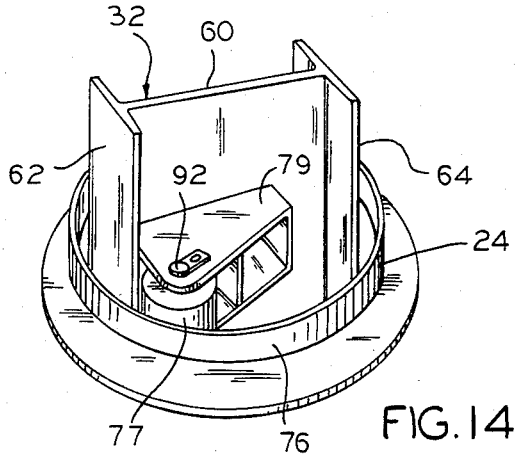
FIG. 14 is a perspective view of the roller bearing means operatively contacting the inside of the pipe.

The roller bearing means 42 includes a pair of rollers 45, 46 rotatably housed inside a substantially rectangular cage 48 (FIGS. 4, 5 and 7). A partition reinforcing wall 49 (FIG. 6) divides the cage 48 into compartments for the rollers 45,46. The rotating axles 50 of the rollers 45,46 are locked in place at the top of the cage 42 by the bar 52 positioned in notches (not shown) in the upper end of the axles 50 and elongated springs 51 (FIG. 13) extending through apertures at the lower end of the axles 50. A bolt 54 secures the bar 52 in place.

Figure 9:
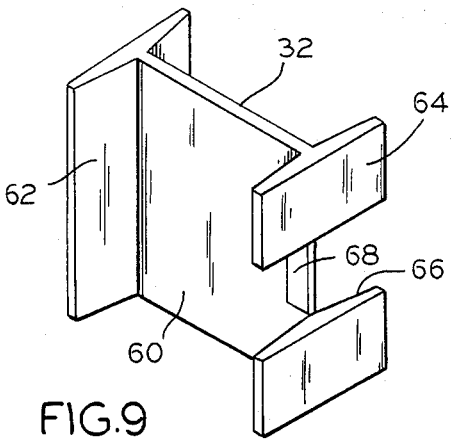
FIG. 9 is a sectional perspective view and showing the cutout from the "I" beam for receiving the thrust bearing means.

The "I" beam pillar 32 includes a body portion 60 sandwiched between and integrally formed to opposed side portions 62,64 (FIG. 9). As may be seen from FIG. 9, a section 66 of side portion 64 and an adjacent section 68 of the body portion 60 are notched out and provide space for receiving the roller bearing means 42. The cage 48 of the roller bearing means 42 is welded to the body portion 60 of the pillar 32, so that the rollers 44,46 frictionally contact the inside surface 44 of the pipe 24. The roller means 42 supports the thrust loads against the inside surface 44 of pipe 24, and may also be referred to as the thrust bearing means.

A plate 72 covers the pipe 24 and keeps contaminants out of the pipe cavity and bearing area and also protects the operator from possible injury due to his fingers getting stuck or pinched from the revolving rollers. An "I" shaped opening 74 is formed in the plate 72, sized to enable the "I" beam pillar to extend through. If access to the roller bearing means 42 is desired, the plate 72 is lifted or forced upward along the pillar 32.

In the assembly of the crane 10, the pillar 32 ("I" beam shape in FIG. 1) extends through the opening 74 in the plate 72. The bottom end 34 of the pillar 32 is positioned in the pipe 24. The pin 36 is pressed into the bearing 40 which is meshed in the bearing cup 22. The rollers 45,46 frictionally contact the inside surface 44 of the pipe 24. The rollers 44,45 are readily accessible from ground level, to afford easy adjustment of the contact of the rollers with the pipe, as will be more fully described below.

In FIGS. 13 through 16, another embodiment for a roller bearing means is illustrated and indicated generally by the reference numeral 76. The roller bearing means 76 comprises a pair of rollers 77,78 rotatably secured respectively to holders 79,80.

Figure 15:
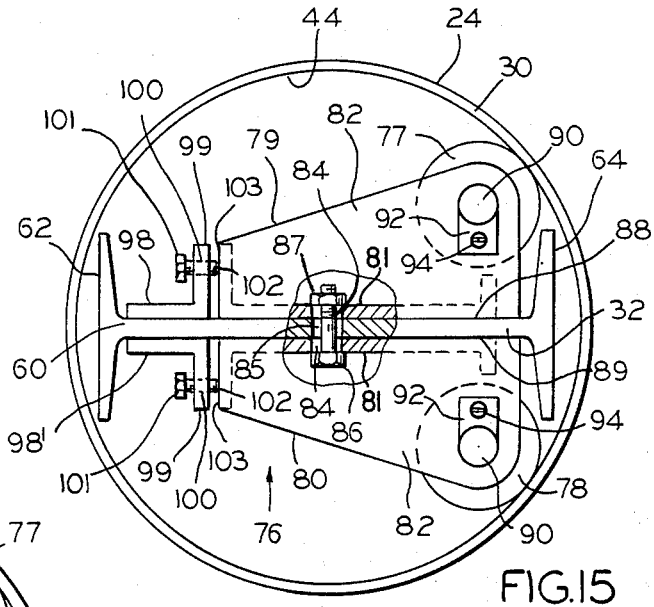
FIG. 15 is a top view of the roller bearing means positioned in the pipe and showing a cut away portion.

The holders 79,80 each comprises a back wall 81, an upper wall 82 and a lower wall 83. Each roller 77,78 is secured between the upper and lower walls 82,83. An opening 84 is formed in the back wall 81 of the holders 79,80. A hole 85 is formed in the pillar 32, preferably located on the central axis of the mast 14. A bolt 86 extends through the openings 84 of the holders 79,80 and the hole 85 in the pillar 32, and fastened in place with a nut 87. The rollers 77,78 and corresponding holders 79,80 are free floating and not welded in place as is the case for the roller bearing means 42 (FIG. 7). The rollers 77,78 are initially brought into contact by the forces exerted thereon by the boom 16, and then secured in place by the nut 87. The rollers 77,78 are positioned on the side of the mast 14 nearest to the outer end of the boom 16, as may be seen in FIG. 1. In this embodiment, the mounting of the holders are achieved without a notch or welding of the holders to the the pillar 32. Therefore, as shown in FIGS. 15 and 16, holder 79 is attached to one surface 88 of the body portion 60 of the pillar 32 and holder 80 is attached to the opposite surface 89 of the body portion of the pillar 32 by means of the bolt 86 and nut 87.

The rollers 77,78 each revolve around a pin 90. A groove (not shown) is formed in the head of the pin 90 to receive one end of a locking finger 92. The finger 92 is attached to the upper wall 82 of the bolt 94. The bottom end (not shown) of the pin 90 includes an opening to receive the wire locking spring or cotter pin 51 for retaining the pin 90 between the finger 92 and spring 51.

Figure 16:
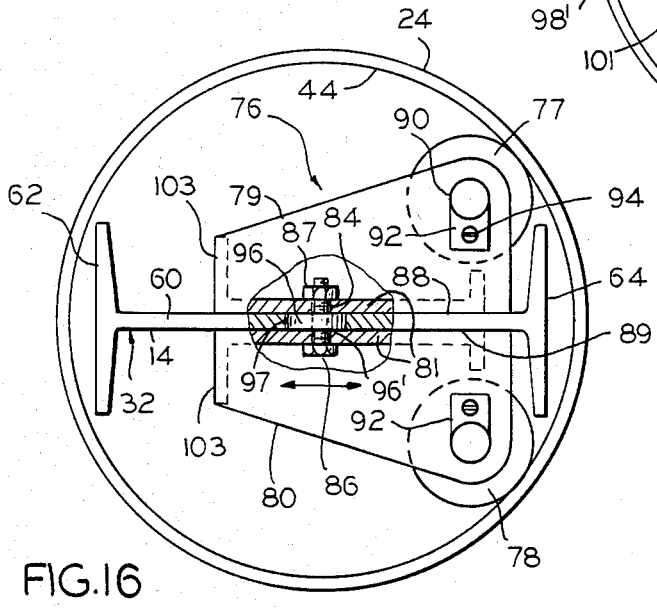
FIG. 16 is a top view of the roller bearing means inside the pipe with a cut away portion to show the eccentric bushing for adjusting the frictional contact of the rollers with the inside of the pipe.

In FIG. 16 an eccentric bushing 96 is shown positioned in a hole 97. The bushing 96 includes an offset apparatus 96' in which the bolt 86 is pressfitted. The rotation of the bolt 86 causes the bushing 96 to rotate and in response thereto the holders 79,80 move toward or away from the inside surface 44 of the pipe 24, thereby adjusting the frictional contact of the rollers 77,78 with the pipe 24. Alternatively and not shown, an eccentric bushing may be secured in each of the openings 84 of the holders 79,80, so that the rotation of the bolt 86 would cause such two eccentric bushings to rotate and the holders 79,80 to move toward or away from the roller contacting surface of the pipe. Also, two bolts could be used with the bushings for independent adjustment of each roller 77,78.

Therefore, since the roller means 76 (also roller means 42) is mounted in the pipe 24 which is near the base of the crane 10, any adjustment required from time to time, is easily accomplished. Moreover, the convenience of the placement of the roller means 76 (also roller means 42) permits frequent checking of the contact of the rollers with the pipe to determine if the load thrust forces are being properly transmitted to the pipe 24.

Substantially right angular brackets 98,98' are mounted to the opposed sides 88,89 of the pillar 32. The outward extending flange 99 of the bracket 98 includes a threaded aperture 100 for receiving a screw member 101. The outer end 102 of the screw 101 from bracket 98 frictionally contacts the side wall 103 of holder 79 and the outer end 102 of the screw 101 from bracket 98' frictionally contacts the side wall 103 of holder 80.

As may be seen in FIG. 15, the diameter of the opening 84 in the back wall 81 of the holders 79,80 is substantially larger than the diameter of bolt 86. Therefore, to move the roller 77 closer to the inside surface 44 of the pipe 24 or in tighter contact therewith, the nut 87 is loosened and screw 101 of bracket 98 is rotated in the direction to cause the outer end 102 to bear against the holder 79 and move the same outward. When it is desired to move the holder 79 in the opposite direction away from the inside surface 44, the screw 101 is rotated out of contact with the holder 79 and the holder is manually moved laterally inward. The size of the opening 84 determines the adjustable length of travel of the holder 79. Similarly, the holder 80 may be adjusted independently of holder 79.

Alternatively, the screw 101 may extend through a threaded aperture in the side wall 103 of the holders 79,80 (not shown). The screw 101 may be rotatable but not movable lengthwise, so that the rotation of the screw causes the holders 79,80 to move inward or outward.

Referring again to FIG. 15, it may also be seen that the diameter of hole 85 in the pillar 32 is larger than the diameter of the bolt 86. Therefore, movement of the bolt 86 laterally within hole 85 affords further adjustment of the rollers 77,78. One of both of the holders 79,80 could be moved laterally upon varying the lateral position of the bolt 86, depending upon the position of the bolt 86 in the opening 84 in the back walls 81 of the holders.

Figure 17:
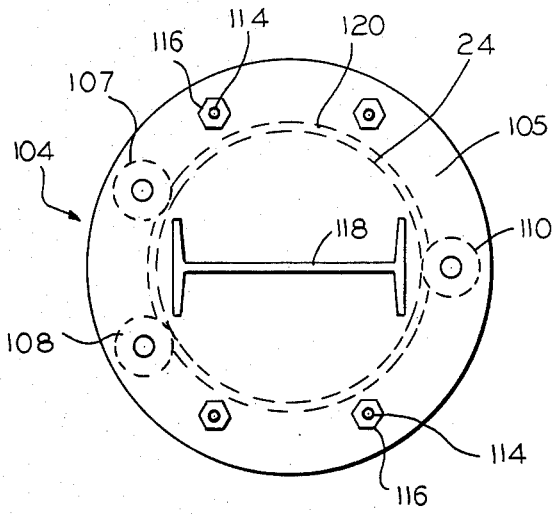
FIG. 17 illustrates a top view of a bearing plate means having rollers mounted thereon, which is another embodiment of the invention herein.
Figure 18:
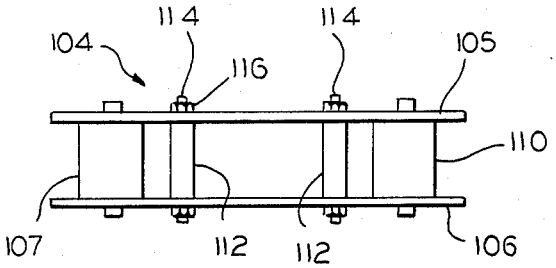
FIG. 18 is a side view of the bearing means in FIG. 17.
Figure 19:
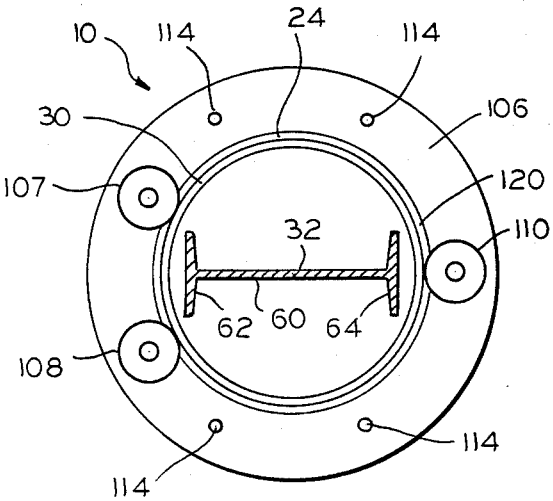
FIG. 19 is a top view of the bearing plate means with the upper plate removed and showing the rollers in contact with the outside of the pipe of the base means.

Referring now to FIGS. 17, 18 and 19, a roller plate assembly indicated generally by the reference numeral 104 is secured to the mast 14 and the pipe 24, and is another embodiment for the roller connection between the mast 14 and the pipe 24. The plate assembly 104 comprises an upper plate 105 (FIG. 17), and a lower plate 106 (FIG. 18). Rollers 107 108, and 110 are mounted between the upper plate 105 and the lower plate 106.

Hollow spacers 112 support the upper and lower plates 105 106 Bars 114 having threaded ends extend through the spacers 112 and are locked in place with nuts 116. The position of the plates may be adjusted with the locking means afforded by the bars 114 and nuts 116.

The upper plate 105 includes an opening 118 shaped to correspond to the cross-section of the "I" beam pillar 32. The lower plate 106 has a circular opening 120 to encircle the pipe 24 without being in contact therewith. The rollers 107, 108 and 110 operatively contact the outside surface 30 of the pipe 24. The pillar 32 is positioned through opening 118 of the upper plate 105, and the rollers 107,108 and 110 frictionally contact the outside surface 30 of the pipe 24. The pillar 32 is secured in place by the cooperation of the upper plate 105, the bearing rollers 107,108 and 110 and the pressfit attachment of the pin 36 at the lower end 34 of the pillar 32 with the bearing 40. The plate assembly 10 revolves in response to the rotation of the pillar 32, and the bearing rollers 107,108 and 110 revolve around the outside circumference of the pipe 24.

Figure 20:
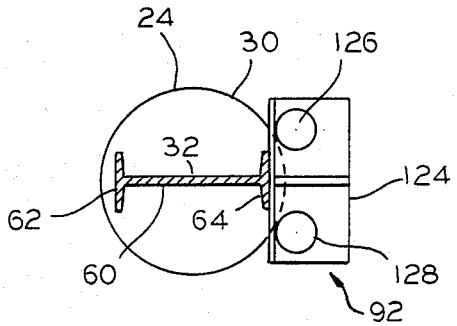
FIG. 20 is still another embodiment for the roller bearing means and illustrates a top view showing the rollers contacting the outside of the pipe.
Figure 21:
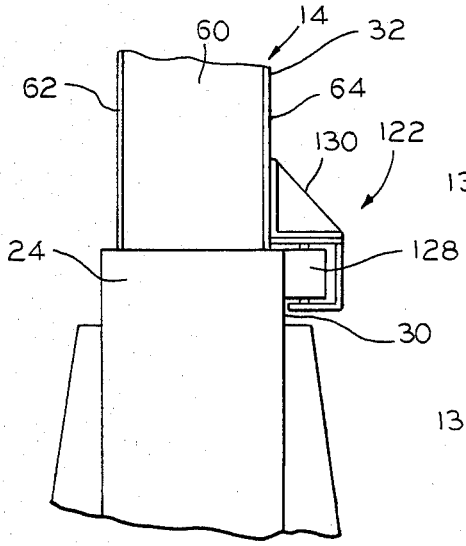
FIG. 21 is a side view of the roller bearing means in FIG. 20.

Turning now to FIGS. 20 and 21, still another embodiment for the thrust roller bearing means indicated generally by the reference numeral 122 will be described. The bearing means 122 comprises a substantially "U" shaped holder 124 in which a pair of spaced apart rollers 126,128 are rotatably mounted. A substantially triangular bracket 130 rigidly secures the holder 124 with the flat outside surface of the flange 64 of the "I" beam pillar 32. The rollers 126,128 protrude out from the holder 124 in frictional contact with the outside surface 30 of the pipe 24, and revolve around the circumference of the pipe 24, as the boom 16 and mast 14 are rotated.

Figure 22:
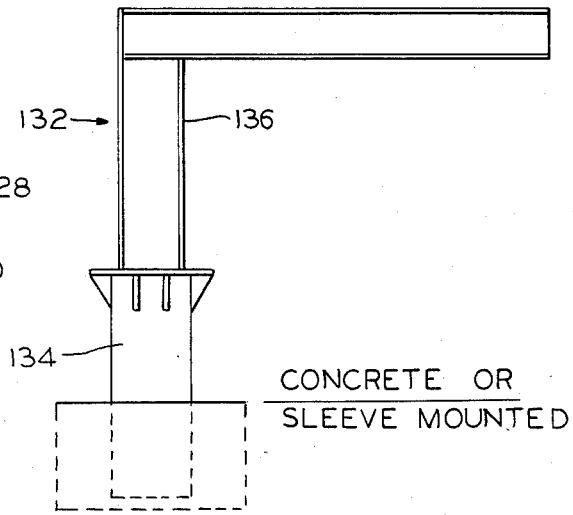
FIG. 22 illustrates the jib crane of FIG. 1 without the base assembly and mounted in the foundation.

In FIG. 22, a jib crane indicated generally by the reference numeral 132 is shown having a pipe 134 secured in the foundation with concrete or mounted inside a sleeve (not shown). The mast 136 is rotatably secured inside the foundation. The jib crane 132 is similar to the jib crane 10 except that the base plate 18 is not used.

A gearing or sprocket arrangement (not shown) may be attached to the mast 14 (or mast 136 in FIG. 22), to enable the mast to be rotated externally by means of an air motor, electric motor, hydraulic motor or hand cranked with turn wheels.

Figure 23:
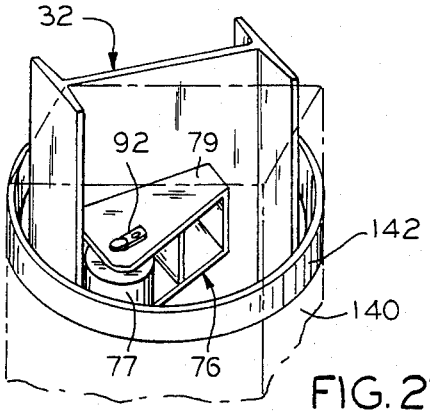
FIG. 23 illustrates roller bearing means revolving around a band secured to a structural member shown in phantom and having a substantially rectangular configuration.

In FIG. 23, an alternate embodiment is illustrated which shows a structural member 140 in phantom for replacing the pipe 24. Structural member 140 is shown as a rectangular configuration, but may have any other suitable configuration. A circular band 142 is welded or otherwise rigidly secured to the structural member 140. The roller bearing means 76 revolves around the band 142 when the mast is rotated.

Although an "I" beam construction for the mast 14 is illustrated, it is understood and as aforestated, the invention herein is suitable for use with various configurations including (but not to be limited thereby) wide flange beam, fabricated plate, rectangular channels or cylindrical tubing.

The description of the preferred embodiments of this invention is intended merely as illustrative of the subject invention, the scope and limits of which are set forth in the following claims:

We claim:

1. A crane comprising:

a base means;

a rotatable mast having a lower end portion and upper end, said mast being I-shaped and having a body portion sandwiched between and integrally formed to opposed side portions;

a load beam rigidly secured to the upper end of the mast and extending laterally outward therefrom to a free end, said load beam rotating with the mast as the mast is rotated;

a hollow pipe secured to the base means, said pipe being spaced from and surrounding said lower end portion of the mast;

a bearing means;

a pin extending downward from said lower end portion of the mast and operatively received in said bearing means;

a bearing cup mounted on said base means and operative to hold said bearing means for rotating said mast and load beam;

a notch formed in one of said side portions and in an adjacent section of said body portion of said mast;

a substantially rectangular cage; and a pair of rollers means rotatably attaching said rollers to the inside of said cage for rotation about spaced vertical axes, said cage being received in said notch and attached to said body portion, said rollers contacting the inside surface of said pipe on the side thereof facing the free end of the load beam and revolving therearound as the mast is rotated.

2. A crane system comprising:

a base means;

a rotatable mast having a lower end portion and an upper end;

a load beam rigidly secured to the upper end of the mast and extending laterally outward therefrom to a free end, said load beam rotating with the mast as the mast is rotated;

a hollow pipe secured to the base means, said pipe being spaced from and surrounding said lower end portion of the mast;

a bearing means;

a pin extending downward from the lower end portion of the mast and operatively received in said bearing means;

a bearing cup mounted on said base means and operative to hold said bearing means to permit rotation of said mast and load beam;

a first holder;

a first roller rotatably secured to said first holder;

a second holder;

a second roller rotatably secured to said second holder, said first and second holders being secured to said mast and said first and second rollers contacting the inside surface of said hollow pipe and revolving therearound as the mast rotates;

each of said holders having an upper wall, a lower wall and a back wall, each of said back walls including an opening formed therein;

a hole formed in the mast;

a bolt extending through said hold and said opening;

means for attaching to said bolt to secure said first holder to one side of the mast and said second holder to the opposite side of the mast; and an eccentric bushing positioned in said hole, said bushing including an aperture for receiving said bolt, whereby the rotation of said bolt causing said bushing to rotate and said holders to move relative to said mast for controlling the contact of said rollers with said inside surface of said pipe.

3. The crane system of claim 2, wherein said bolt is threaded and said means for attaching to said bolt is a nut threadedly receiving said bolt for securing said holders to said mast.

4. A crane system comprising:

a base means;

a rotatable mast having a lower end portion and an upper end;

a load beam rigidly secured to the upper end of the mast and extending laterally outward therefrom to a free end, said load beam rotating with the mast as the mast is rotated;

a hollow pipe secured to the base means said pipe being spaced from and surrounding said lower end portion of the mast;

a bearing means;

a pin extending downward from the lower end portion of the mast and operatively received in said bearing means;

a bearing cup mounted on said base means and operatively holding said bearing means to permit rotation said mast and load beam;

a first holder;

a first roller rotatably secured to said first holder;

a second holder;

a second roller rotatably secured to said second holder, said first and second rollers contacting the inside surface of said hollow pipe;

each of said holders being a channel member having a upper wall, lower wall side wall and a back wall including an opening therein;

a hole formed in said mast;

a bolt extending through said one hole and said openings of the first and second holders each of said openings being larger than the diameter of said bolt;

means cooperating with the bolt for securing said holders to the mast;

a pair of flanges secured to the mast and extending outward therefrom and including a threaded aperature; and a screw for each of said threaded aperature and passing therethrough for contacting the side wall of said respective first and second holders, whereby rotation of said screw when said last-mentioned means is not securing said holders to said mast thereby enabling said holders to be moved relative to said mast for adjusting the contact of said rollers with said inside surface of said hollow pipe, the extent of the movement of said holders being determined by said size of said opening of said holders with respect to said bolt.

* * * * *